US006488002B1

(12) United States Patent
Vernhes

(10) Patent No.: US 6,488,002 B1
(45) Date of Patent: Dec. 3, 2002

(54) MOTOR VEHICLE ENGINE UNIT OIL TANK

(75) Inventor: Pierre-Louis Vernhes, Lyons (FR)

(73) Assignee: Renault VI (FR)

( * ) Notice: Subject to any disclaimer, the term of this patent is extended or adjusted under 35 U.S.C. 154(b) by 0 days.

(21) Appl. No.: 09/701,571

(22) PCT Filed: May 28, 1999

(86) PCT No.: PCT/FR99/01256

§ 371 (c)(1),
(2), (4) Date: Mar. 22, 2001

(87) PCT Pub. No.: WO99/64730

PCT Pub. Date: Dec. 16, 1999

(30) Foreign Application Priority Data

Jun. 8, 1998 (FR) ..... 98 07172

(51) Int. Cl.[7] ..... F01M 1/00
(52) U.S. Cl. ..... 123/196 R; 184/6.13
(58) Field of Search ..... 123/196 R, 196 AB; 184/6.13

(56) References Cited

U.S. PATENT DOCUMENTS 4,378,763 A * 4/1983 Ishihama ..... 123/196 R
4,524,735 A * 6/1985 Bauder ..... 123/196 R
4,674,457 A * 6/1987 Berger et al. ..... 123/196 R
4,677,947 A * 7/1987 Bousquet ..... 123/196 R
4,909,203 A * 3/1990 Fukuo ..... 123/196 R
5,158,053 A * 10/1992 Krechberger et al. ... 123/196 R
5,740,772 A * 4/1998 Bluma ..... 123/196 AB
5,887,562 A * 3/1999 Von Esebeck et al. .. 123/196 R
5,960,763 A * 10/1999 Yamamura ..... 123/196 R
6,216,651 B1 * 4/2001 Ishikawa et al. ..... 123/196 AB

* cited by examiner

*Primary Examiner*—Noah P. Kamen
*Assistant Examiner*—J A Benton
(74) *Attorney, Agent, or Firm*—Howrey Simon; Arnold & White LLP

(57) ABSTRACT

A lubricating oil tank for an engine unit arranged in a motor vehicle engine compartment, open from below, including a flat-shaped tank arranged in the compartment lower part, beneath the engine unit, and connected to the engine unit by an oil outlet conduit and by an oil inlet conduit connected to the engine oil pump. The tank includes a part connected to the oil outlet conduit and a lower part connected to the oil inlet conduit.

13 Claims, 2 Drawing Sheets

MOTOR VEHICLE ENGINE UNIT OIL TANK

BACKGROUND OF THE INVENTION

1. Field of the Invention

The present invention relates to an oil reservoir for the engine unit of a motor vehicle.

2. Discussion of the Background

It is common for engine units of motor vehicles to comprise a main crankcase which is open at the bottom and a pan fixed on the lower peripheral rim of the main crankcase to constitute a reserve for lubricating oil of the engine unit, a pump making it possible to circulate the lubricating oil from this reserve through the members of the engine unit.

SUMMARY OF THE INVENTION

The purpose of the present invention is to propose a radically different solution.

The object of the invention is a lubricating oil reservoir for the engine unit disposed in a motor-vehicle engine compartment, open at the bottom, the reservoir comprising a tank of flat shape which is disposed in the lower portion of the said compartment, underneath the said engine unit, and which is in communication with the said engine unit on the one hand by at least one oil outlet conduit and on the other hand by at least one oil inlet conduit connected to the oil pump of the said engine unit.

According to the invention, the said tank may advantageously comprise a low portion in communication with the said oil inlet conduit.

According to the invention, the said outlet conduit is preferably in communication with the lower portion of a pan of the said engine unit.

According to the invention, the said tank preferably extends approximately over the entire surface of the lower portion of the said compartment.

According to the invention, the said tank is preferably disposed at least partly in the air flow delivered by the fan of the said engine unit and the air flow under the vehicle.

According to the invention, the wall of the said tank preferably comprises projecting external and/or internal ribs.

According to the invention, the said conduits are preferably deformable.

According to the invention, the said tank can advantageously be fixed at least partly to the structure of the said vehicle.

According to the invention, the means of fixation of the said tank to the structure of the said vehicle are preferably deformable.

According to the invention, the said tank can advantageously be fixed at least partly to the said engine unit.

According to the invention, the means of fixation of the said tank to the said engine unit are preferably deformable.

Thus the solution proposed by the invention makes it possible in particular to use gravity to feed the lubricating oil from the crankcase to the tank, to improve the cooling of the lubricating oil, and to use the tank as a means of masking the noise of the engine unit.

BRIEF DESCRIPTION OF THE DRAWING

The present invention will be better understood by studying an engine unit of a motor vehicle equipped with a lubricating oil reservoir, described by way of nonlimitative example and illustrated by the drawing, wherein.

DESCRIPTION OF THE PREFERRED EMBODIMENTS

Figure 1:
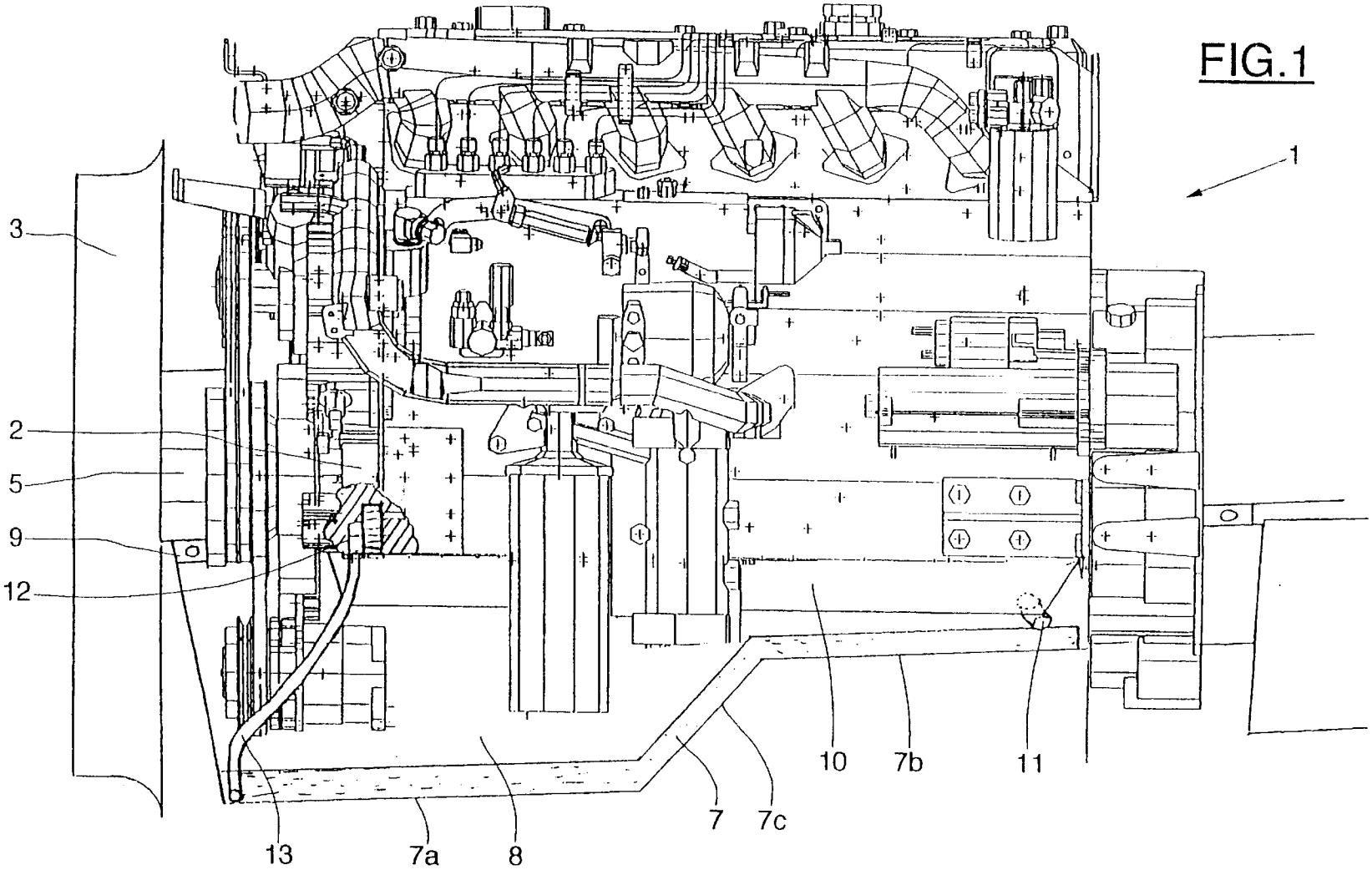
FIG. 1 represents a longitudinal view of an engine unit of a motor vehicle, the lubricating oil reservoir being shown in section.

Referring to the figures, it is seen that there is shown an engine unit 1 of a motor vehicle, all accessories of which are carried by a crankcase 2 and at the front of which there is provided a fan unit 3.

Engine unit 1 is disposed in a vehicle compartment 4, whose structure or frame comprises two longitudinal members 5 which extend on both sides and at a distance from engine unit 1.

Engine unit 1 is equipped with an oil tank 6 of small thickness and of large oppositely disposed main surfaces, whose walls are made, for example, of sheet metal.

This tank 6 is provided with a portion 7 which extends substantially horizontally underneath and at a distance from engine unit 1, as well as with longitudinal sides 8 which extend upwardly such that tank 6, in cross section, has substantially a U-shaped appearance, the bottom being formed by portion 7 and the branches 8 spreading apart therefrom, the upper rims of sides 8 extending to just below longitudinal members 5.

In the illustrated example, portion 7 of tank 6 is provided with a front portion 7*a*, which is situated at a level lower than its rear portion 7*b*, these portions 7*a* and 7*b* being connected by an intermediate portion 7*c* inclined toward the front.

Tank 6 is suspended on the vehicle frame by virtue of binding strips 9, which join the upper rims of its sides 8 to the lower portions of longitudinal members 5, these strips 9 preferably incorporating a deformable material for the purpose of absorbing vibrations and dimensional variations.

High rear portion 7*b* of tank 8 is in communication with a dry lower pan 10 of engine unit 1 via an outlet conduit 11, pan 10 being disposed in such a way that it collects the lubricating oil circulating in engine unit 1.

Low portion 7*a* of tank 6 is in communication with the inlet of an oil pump 12 of engine unit 1 via an inlet conduit 13.

Conduits 11 and 13 are preferably made at least partly of deformable material, so that they can absorb the vibrations and the dimensional variations.

Thus the lubricating oil collected in pan 10 of the engine unit descends by gravity in outlet conduit 11 and enters portion 7*b* of tank 6.

Pump 12 of engine unit 1 sucks lubricating oil from the lowest portion 7*a* of tank 6 via conduit 13, the oil in tank 6 descending by gravity from its rear high portion to its front low portion.

Thus tank 6 constitutes a lubricating oil reservoir exterior to engine unit 1.

In view of its location, lubricating oil tank 6 is disposed in the air flow circulating in the lower portion of vehicle compartment 4, underneath engine unit 1. It is also disposed in the air flow generated by fan unit 3 and the air circulating under the vehicle.

Figure 2:
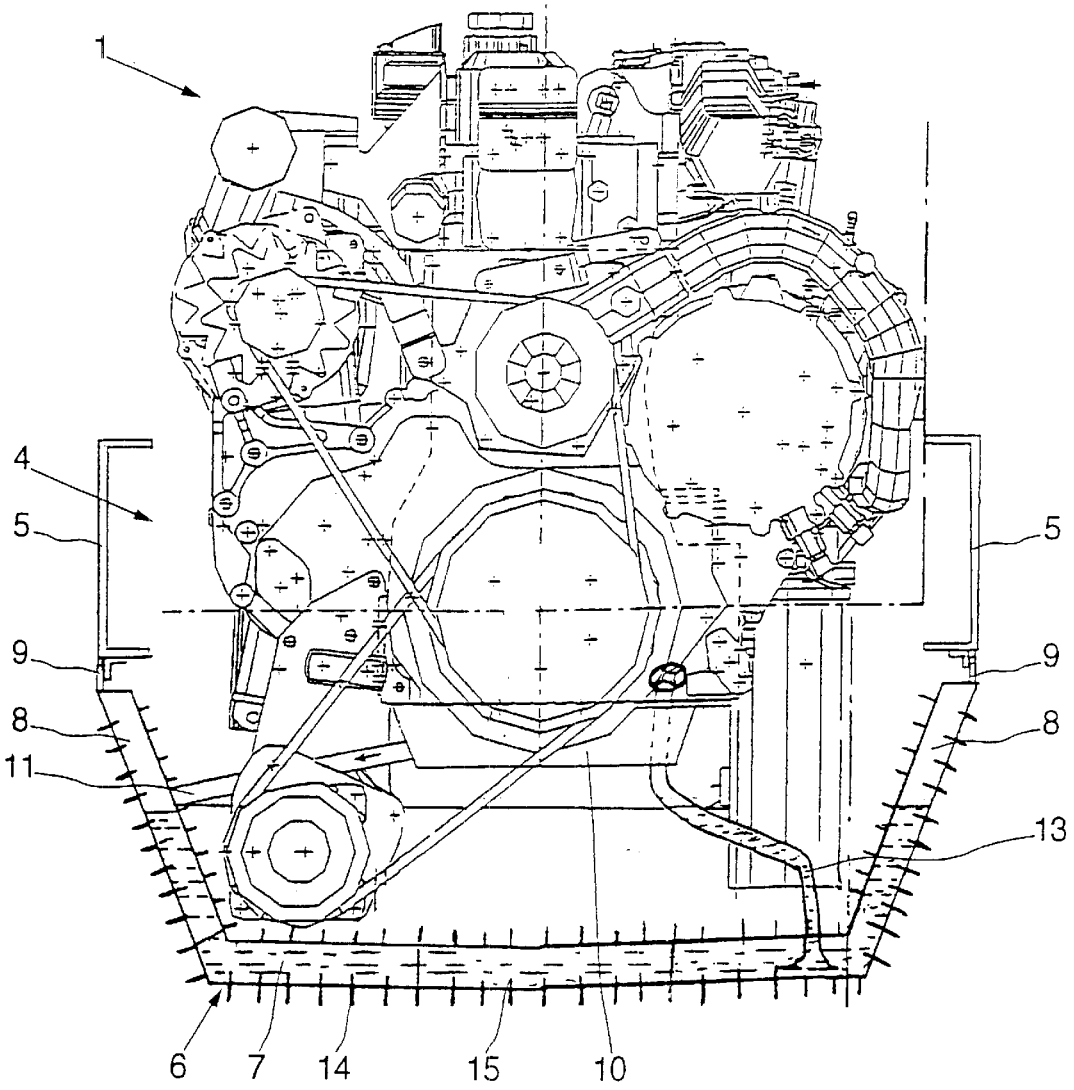
FIG. 2 represents an end view of the said engine unit, the lubricating oil reservoir being shown in cross section.

To improve heat transfer between lubricating oil tank 6 and the air flow circulating around it, the walls of tank 6 are provided with external ribs 14 and internal ribs 15, represented schematically in FIG. 2 and made in standard manner.

In addition, since lubricating oil tank 6 extends virtually over the entire surface of the lower portion of vehicle compartment 4, it contributes to masking the noise generated by engine unit I disposed in this compartment, since its surface can be lined advantageously with sound-absorbing material.

In addition, since engine unit 1 no longer comprises a bulky internal oil reservoir, the lower portion of its crankcase 2 can be advantageously reduced in size and contribute to the reinforcement and rigidity of the engine.

What is claimed is:

1. A lubricating oil reservoir for an engine unit in a motor vehicle, comprising:

a tank disposed underneath the engine unit, the tank extending to substantially cover a lower portion of the engine unit;

at least one oil outlet conduit communicating the tank and the engine unit; and at least one oil inlet conduit communicating the tank and the engine unit via an oil pump.

2. A reservoir according to claim 1, wherein the tank comprises a high portion in communication with the at least one oil outlet conduit and a low portion in communication with the at least one oil inlet conduit.

3. A reservoir according to claim 1, wherein the at least one oil outlet conduit is in communication with a lower portion of a pan in the engine unit.

4. A reservoir according to claim 1, wherein the tank extends to cover an entire surface of the lower portion of the engine unit.

5. A reservoir according to claim 1, wherein the tank is positioned such that the tank is subjected to at least partly an air flow delivered by a fan provided in tile engine unit and air flowing under the motor vehicle.

6. A reservoir according to claim 1, wherein the tank comprises at least one of plural external ribs and plural internal ribs respectively projecting externally and internally in the tank.

7. A reservoir according to claim 1, wherein the at least one of oil inlet conduit and at least one oil outlet conduit are deformable.

8. A reservoir according to claim 1, wherein the tank is fixed at least partly to the motor vehicle.

9. A reservoir according to claim 8, characterized in that the means of fixation of the said tank to the structure of the said vehicle are deformable.

10. A reservoir according to claim 1, wherein the tank is fixed at least partly to the engine unit.

11. A reservoir according to claim 10, wherein the tank is fixed to the said engine unit via deformable fixing means.

12. A reservoir according to claim 1, wherein the tank is lined with a sound-absorbing material.

13. A reservoir according to claim 4, wherein the tank is lined with a sound-absorbing material.

* * * * *